US006292153B1

(12) United States Patent
Aiello et al.

(10) Patent No.: US 6,292,153 B1
(45) Date of Patent: Sep. 18, 2001

(54) ANTENNA COMPRISING TWO WIDEBAND NOTCH REGIONS ON ONE COPLANAR SUBSTRATE

(75) Inventors: G. Roberto Aiello, Palo Alto, CA (US); Patricia R. Foster, Malvern (GB)

(73) Assignee: Fantasma Network, Inc., Palo Alto, CA (US)

( * ) Notice: Subject to any disclaimer, the term of this patent is extended or adjusted under 35 U.S.C. 154(b) by 0 days.

(21) Appl. No.: 09/692,906

(22) Filed: Oct. 19, 2000

Related U.S. Application Data

(63) Continuation of application No. 09/384,952, filed on Aug. 27, 1999.

(51) Int. Cl.[7] ..... H01Q 13/08
(52) U.S. Cl. ..... 343/767; 343/770
(58) Field of Search ..... 343/767, 770, 343/700 MS, 727, 771, 860, 863, 908

(56) References Cited

U.S. PATENT DOCUMENTS 4,500,887 * 2/1985 Nester ..... 343/700 MS
4,843,403 * 6/1989 Lalezari et al. ..... 343/767
4,855,749 * 8/1989 DeFonzo ..... 343/700 MS
4,978,965 * 12/1990 Mohuchy ..... 343/727
5,070,340 * 12/1991 Diaz ..... 343/767
5,081,466 * 1/1992 Bitter, Jr. ..... 343/767
5,142,255 * 8/1992 Chang et al. ..... 343/767
5,748,153 * 5/1998 McKinzie, III et al. ..... 343/767

* cited by examiner

*Primary Examiner*—Don Wong
*Assistant Examiner*—Thuy Vinh Tran
(74) *Attorney, Agent, or Firm*—Sierra Patent Group, Ltd.

(57) ABSTRACT

A broadband transmit/recieve antenna apparatus which operates at high frequencies and provides for two separate wideband tapered notch regions formed on one coplanar substrate. The tapered notch regions function as radiators for the transmission and reception of electromagnetic signals. The simple and compact design for the broadband antenna permits the transmission and reception of high frequency omnidirectional or directional radiation patterns. The broadband antenna interfaces with an an integrated circuit such as an ASIC which provides a series of pulsed signals and is resident on the antenna. The design of the broadband antenna provides for an optional stop notch to separate the transmitting portion of the antenna from the receiving portion of the antenna. Additionally, the antenna provides for impedance matching by locating transmission lines at an appropriate location with respect to the tapered notch radiators.

18 Claims, 3 Drawing Sheets

ANTENNA COMPRISING TWO WIDEBAND NOTCH REGIONS ON ONE COPLANAR SUBSTRATE

CROSS-REFERENCE TO RELATED APPLICATION

Figures 1A, 1B, 1C:
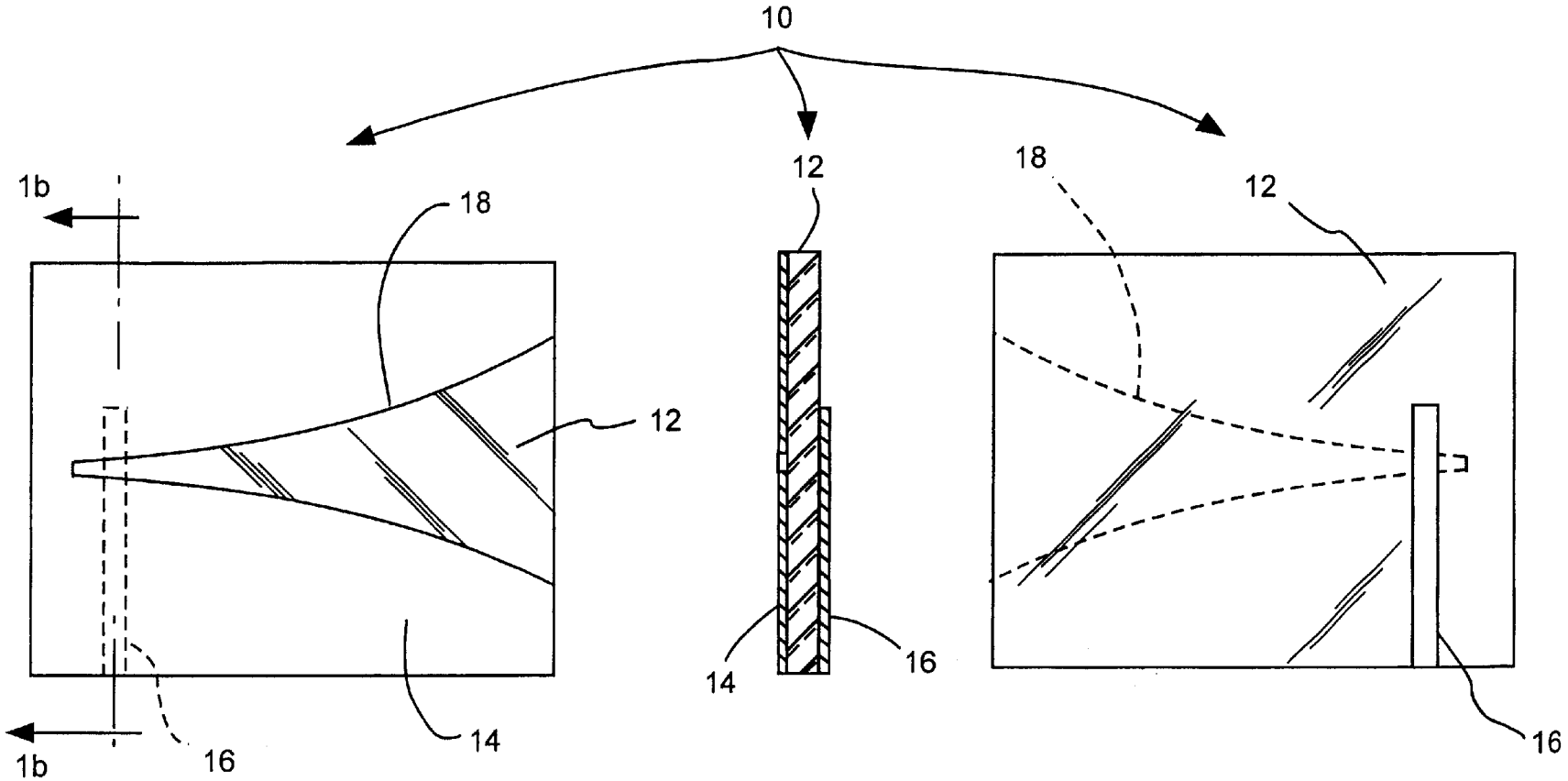
Fig.1c (Prior Art)
Fig.1b (Prior Art)
Fig.1a (Prior Art)

This application is a continuation of U.S. application Ser. No. 09/384,952 filed Aug. 27, 1999.

BACKGROUND OF THE INVENTION

1. Field of the Invention

The present invention relates to printed radiating antennas. More particularly, the present invention relates to a novel antenna structure comprising two separate wideband notch regions formed on one coplanar substrate.

2. The Prior Art

The use of antennas has become commonplace in electronic devices such as cellular phones, radios, television, and computer networks. An antenna is comprised of a system of wires or other conductors used to transmit or receive radio or other electromagnetic waves.

Many antennas are highly resonant, operating over bandwidths of only a few percent. Such "tuned," narrowbandwidth antennas may be entirely satisfactory or even desirable for single-frequency or narrowband applications. However, in many situations wider bandwidths are desirable. Such an antenna capable of functioning satisfactorily over a wide range of frequencies is generally referred to as a broadband antenna.

One of the well-known prior art antennas is the exponential notch antenna. The exponential notch takes the form of a substrate such as a circuit board having a conductive surface disposed thereon. An exponential notch is removed from the conductive surface and the antenna is coupled to a 50-Ω strip line on an opposing surface of the board. This small broadband antenna is well adapted for printed-circuit fabrication.

Another prior art antenna is disclosed in U.S. Pat. No. 4,853,704 issued to Diaz et al. It has a wide bandwidth and one antenna input port. The Diaz et al. antenna comprises a strip conductor, a ground plane separated from and lying parallel to the strip conductor, the grouped plane having a slot therein, the slot extending transverse to the strip conductor, a conductive planar element positioned across the slot and orthogonal to the ground plane, the conductive planar element having curved surfaces extending upwardly and outwardly from the slot. The strip conductor and the ground provided with a slot are generally composed of a dielectric material.

U.S. Pat. No. 5,519,408 issued to Schnetzer discloses a printed tapered notch (coplanar) antenna which has wide bandwidths and one antenna input. The antenna includes a radiating tapered notch and is fed by a section of slotline, which in turn is fed by a coplanar waveguide. The transition from the unbalanced coplanar waveguide to the balanced slotline is accomplished by an infinite balun, where the center conductor of coplanar waveguide terminates on the slotline conductor opposite the ground conductor of the coplanar waveguide. One slot of the coplaner waveguide becomes the feeding slotline for the notch, and the other slot terminates in a slotline open circuit.

U.S. Pat. No. 5,264,860 issued to Quan discloses a flared notch radiator antenna having separate isolated transmit and receive ports. The assembly includes a flared notch radiating element, a transmit port and a receive port, and a signal duplexer is integrated into the assembly for coupling the radiating element to the respective transmit and receive ports. The duplexer provides for coupling the transmit port to the radiating element so that transmit signals are radiated into free space. The duplexer is described as being capable of coupling the radiating element to the receive port so that signals received at the radiating element are coupled to the receive port, and for isolating the transmit port from the receive port. In its preferred embodiment the duplexer is described as a four port circulator, with a first port connected to the transmit port, a second port connected to the balun which couples energy into and out of the flared notch radiator, a third port connected to the receive port, and a fourth port connected to a balanced load. In this manner, the transmit port is isolated from the receive port, and vice versa.

United Kingdom Patent Application No. 2,281,662 issued to Alcatel Espace discloses a printed coplanar notch (single port) with an integrated amplifier. The antenna includes a slot line having an end section with a flared profile to form a Vivaldi antenna. The slot line has an open circuit termination which provides impedance matching so that separate matching circuit is not required between the antenna and an associated low noise amplifier. A series of antennas are disposed in an array to enable localization to be performed by interferometric techniques.

These aforementioned approaches and examples appear to resolve some of the problems associated with transmitting and receiving signals over the broadband frequency range. Additionally, the prior art teaches the use of a plurality of broadband antennas for transmitting and receiving radio frequency energy.

However, none of these inventions teaches a coplanar antenna with two wideband notch radiators operating in a transmit/receive mode which allows separate paths for the transmit and receive antennas so that the transceiver does not require a selection switch.

Accordingly it is an object of the invention to provide a broadband antenna design which is lightweight, simple and compact in design, and inexpensive to manufacture.

Another object of the invention is to provide a single transmit and receive antenna that avoids the need to switch between transmit/receive functions.

It is a further object to provide a broadband antenna having a plurality of geometric configurations to generate an omnidirectional or directional radiation pattern.

Another object of the invention is to provide an antenna that can be used for wireless communication systems.

Other objects, together with the foregoing are attained in the exercise of the invention in the following description and resulting in the embodiments described with respect to the accompanying drawings.

BRIEF DESCRIPTION OF THE INVENTION

The present invention is a simplified coplanar antenna having at least two notch radiators operating in a transmit/receive mode which produce radiation characteristics that are omnidirectional or directional depending on the size of the antenna.

The omnidirectional and directional antenna designs of the present invention operate over a specified frequency range. The specified operating frequency range is determined by the relative size and shape of the notched regions performing the receiving and transmitting functions of the antenna.

The present invention comprises a transmitting and receiving antenna having separate wideband notch regions on one coplanar substrate. The coplanar substrate has a first face and a second face. The first face has a first wideband notch region for transmission and a second wideband notch region for reception. An optional stop notch may be added to improve the isolation between the transmitting and receiving regions. The second face of the coplanar substrate has two conducting lines acting as transmission lines which are coupled to an integrated circuit. By way of example and not of limitation, such a integrated circuit may include an application specific integrated circuit (ASIC) resident on the second face of the coplanar substrate. The ASIC generates or receives modulated signals which are transmitted or received by the antenna.

According to the present invention, each conducting line or radial stub is electrically coupled to the respective wideband notch regions on the first face of the substrate. The electrical coupling between the transmission lines and the notched regions may be performed by resistively coupling the transmission lines and the notched regions using a plated via-hole technique. However, in the preferred embodiment, the conductive line or radial stub is capacitively coupled to the notched regions to reduce errors, complexity, and costs.

In operation, a signal is radiated from one notched region of the broadband antenna of the present invention. The signal propagates through the edges of the notched region producing a beam polarized in the direction of the edges. A second notched region comprises the receiving antenna.

The antenna of the present invention can be made omnidirectional by fabricating an antenna with a small footprint. One significant design parameter for producing an omnidirectional antenna is size. The specific shape of the antenna periphery is not a critical parameter for generating an omnidirectional radiation pattern. The omnidirectional antenna may be configured as square, rectangle, octagon, circle or any other similar shape.

Directional antennas have larger dimensions than omnidirectional antennas operating in the same frequency range. In general, directional antennas have lengths and widths which are double the length and width of the omnidirectional antennas. Additionally, directional antennas may have an additional backplate or a thick strip of metal on the back edge.

BRIEF DESCRIPTION OF THE DRAWING FIGURES

FIG. 1*a* is a top view of a typical prior-art notch antenna on a coplanar substrate consisting of a dielectric sheet sandwiched between a conductive layer and a conductive line transmission line.

FIG. 1*b* is a cross sectional view of the prior-art notch antenna of FIG. 1*a*.

FIG. 1*c* is a bottom view of the prior-art notch antenna of FIG. 1*a*.

Figures 2A, 2B, 2C:
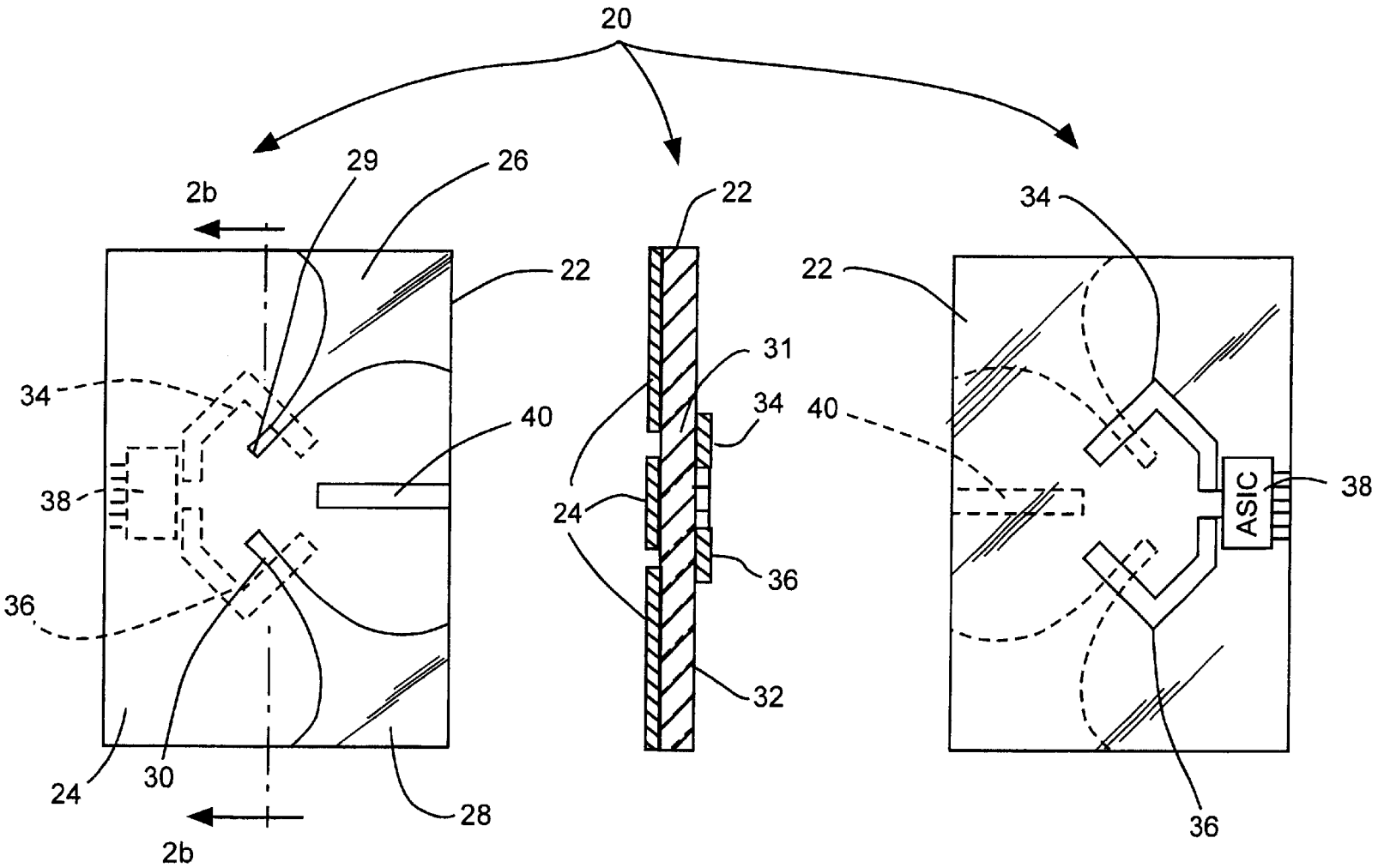

FIG. 2*a* is a top view of a broadband antenna according to the present invention including two notch regions disposed on the corners of a substrate and having an ASIC on the antenna.

FIG. 2*b* is a cross sectional view of the antenna of FIG. 2*a*.

FIG. 2*c* is a bottom view of the antenna of FIG. 2*a*.

Figures 3A, 3B:
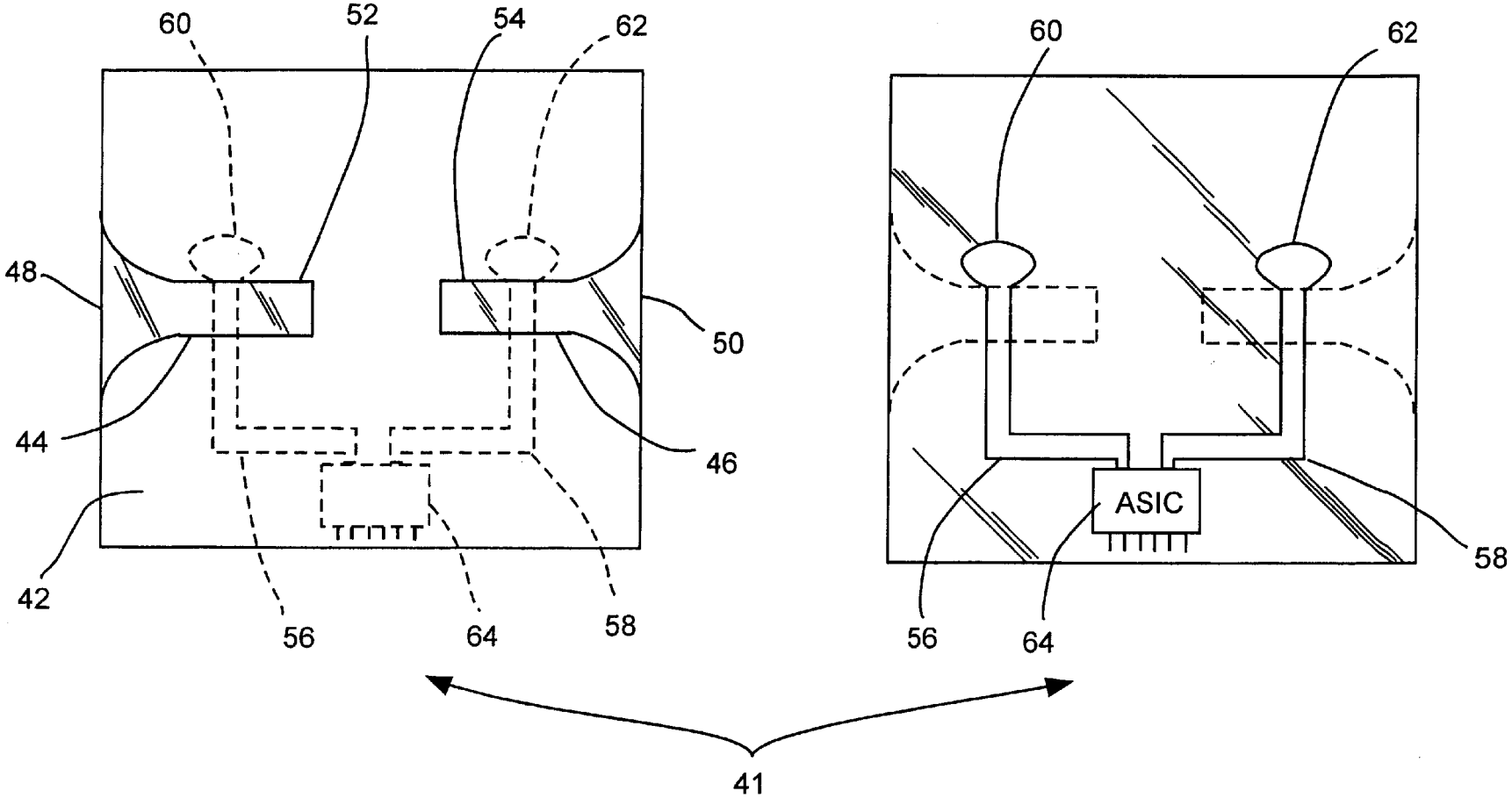

FIG. 3*a* is a top view of a broadband antenna according to the present invention including two notch regions disposed in a symmetrical back-to-back arrangement with connectors on the same side.

FIG. 3*b* is a bottom view of the antenna of FIG. 3*a*.

DETAILED DESCRIPTION OF PREFERRED EMBODIMENTS

Persons of ordinary skill in the art will realize that the following description of the present invention is illustrative only and not in any way limiting. Other embodiments of the invention will readily suggest themselves to such skilled persons having the benefit of this disclosure.

The present invention is a novel antenna comprising two separate wideband notch regions on one coplanar substrate for transmitting and receiving RF signals. Further details for the invention are provided in provisional application Ser. No. 60/106,734 to inventors Aiello et al., entitled Baseband Spread Spectrum System filed on Nov. 2, 1998, which is hereby incorporated by reference.

Referring first to FIGS. 1*a* through 1*c*, there is shown a conventional (prior art) notch antenna 10 comprising a substrate formed from a sheet of dielectric material 12 sandwiched between a conducting element 14 and a feed strip transmission line 16. FIG. 1*a* is a top view showing the antenna face of the dielectric 12. A single tapered notch 18 is disposed in conducting element 14. The tapered notch 18 is transverse to the feed strip 16 and is capacitively coupled to the feed strip 16.

Referring to FIG. 1*b*, there is shown a cross sectional view of the antenna 10 having notch 18 removed from conducting element 14. Antenna 10 is capacitively coupled to feed strip transmission line 16 on the opposing face, i.e. bottom, of dielectric material 12. FIG. 1*c* is a bottom view of the antenna 10 showing feed strip transmission line 16. Persons of ordinary skill in the art will appreciate that conducting element 14 and feed strip transmission line 16 may be formed on the substrate 12 by numerous methods including plating and etching, and various other known deposition techniques It is well known in the art that a matching circuit (not shown) may be electrically coupled to the conducting element 14 and the feed strip 16 to achieve the required impedance matching. Additionally, it is well known in the art that feed strip 16 may also be referred to as a transmission line.

Referring now to FIGS. 2*a* through 2*c*, a first embodiment of the broadband antenna of the present invention is shown in top, cross sectional, and bottom views, respectively.

FIG. 2*a* is a top view of an omnidirectional broadband antenna 20 according to the present invention. The antenna 20 is formed on a coplanar substrate 22 such as FR-4 or RT-Duroid which is commonly used in circuit board design and is fabricated from a material such as polytetraflouroethylene (PTFE) or fiberglass. One suitable material for the substrate 22 is sold by Rogers Corporation under the trademark "RT Duroid 5000" and has a thickness of about 1.544 mm in the present example. The substrate 22, in the embodiment of FIGS. 2*a* through 2*c*, is rectangularly shaped for an omnidirectional pattern. Selection of the substrate 22 is based on its electrical and electromagnetic properties as well as cost. By way of example and not of limitation, the particular broadband antenna specifications for antenna 20 are designed transmit and receive signals from the 2.5 GHz to 5.0 GHz frequency range and has a length of 135 mm and width of 60 mm.

A conductive layer 24 is formed on a first face of the substrate 22 by etching a plated substrate or by electrochemical plating. Generally, the conductive layer 24 is comprised of materials such as copper, silver, conducting alloys or other conducting materials. By way of example and not of limitation, the conducting layer has a thickness which may range from about 0.034 mm to about 0.068 mm.

The conductive layer 24 is shaped in an arrangement having three lobes, in which the lobes are separated by the tapered notches 26 and 28. The tapered notches 26 and 28 are geometrically configured as exponential notches or have a radius of curvature which matches the quadrant of a circle or any other type of similar outline. The shape of the tapered notches 26 and 28 depends on the desired bandwidth, size of the antenna, and matching impedance. Each of the tapered notches 26 and 28 has a respective broad end at the edge of the conductive layer 24 which is shaped to have a width that is of the order of one quarter of the wavelength of the center frequency of the respective frequency range. The broad end of the first tapered notch 26 is disposed on the upper right hand corner of substrate 22 as seen in FIG. 2*a* and functions as a transmitting radiator for electromagnetic signals. The broad end of the second tapered notch 28 is disposed on the bottom right hand corner as seen in FIG. 2*a* and functions as a receiver. Each of tapered notches 26 and 28 taper down to slotlines 29 and 30, respectively.

FIG. 2*b* is a cross-sectional view of the antenna of FIG. 2*a* showing the conductive elements on substrate 22 at feed points 31 and 32. The first conductive line 34 acts as a first transmission line which is capacitively coupled to the first notch 26 at a feed point 31. The second conductive line 36 is a second transmission line capacitively coupled to the second notch 28 at a feed point 32. Alternatively, instead of capacitive coupling, a plated via hole technique may be used to resistively couple the transmission line with the respective tapered notches. However capacitive coupling is preferred because capacitive coupling reduces errors, complexity and costs. Although not shown, a radial stub may may be provided at the end of conducting line 34 and 36 to improve the capacitive coupling between the transmission lines and the notch transducers 26 and 28.

FIG. 2*c* is a bottom view showing conductive lines 34 and 36 positioned orthogonally to each of the notches 26 and 28. It may be appreciated that first conductive line 34 is electrically coupled to first tapered notch 26 and may operate to either transmit or receive RF signals. However, the electrically coupled first notched region 26 and conductive line 34 can not simultaneously transmit and receive RF signals. The electrical properties of the conductive lines 34 and 36 are similar to the electrical properties of conductive layer 24.

Additionally, as shown in FIG. 2*c*, an application specific integrated circuit (ASIC) 38 is electrically coupled to each feed line 34 and 36. The ASIC 38 transmits and receives modulated signals. Note, that in the prior art it is well known to use a switching type circuit to switch from a transmission signal to a reception signal. However, in this invention a switching circuit is not employed.

In FIG. 2*a* and FIG. 2*c*, a stop notch 40 separates the transmit and receive portions of antenna 20 associated with tapered notches 26 and 28. Stop notch 40 is particularly beneficial because it increases the isolation between the transmit and receive portions of antenna 20. However, for the present invention to perform the transmit/receive functions, stop notch 40 is not a necessary element of the invention. Stop notch 40 is generally formed as a rectangularly shaped slot etched from the conductive layer 24.

In operation, the tapered notched antenna of FIGS. 2*a* through 2*c* transmits and receives pulsed signals in the specified frequency range. Transmitting signals are launched from the first tapered notch 26 which is capacitively coupled to the transmission line comprising conductive line 34, and generates a beam polarized in a direction parallel to the antenna. Receiving signals are intercepted by the second tapered notch 28 which is capacitively coupled to transmission line 36.

To obtain a radiation pattern that is substantially omnidirectional, the antenna size must be small and the area of the antenna must approximate or be less than 0.6 times the square of the wavelength at the center frequency of the transmitting or receiving frequency range for each antenna. By way of example and not of limitation, for a center frequency of 3.75 GHz the wavelength of the center frequency is 80 mm. For an omnidirectional radiation pattern the area of the antenna must approximate or be less than the square of the 80 mm wavelength multiplied by 0.6 which is 3,840 $mm^2$ for one antenna, or 7,680 $mm^2$ for two antennas. For an omnidirectional radiation pattern the shape of the coplanar antenna is immaterial and may be square, rectangular, octagonal, circular or some other shape. It shall be appreciated that antenna 20 comprises two antennas, a receiving antenna and a transmitting antenna, with a total length of 135 mm and a width of 60 mm. The total area for antenna 20 is 8100 $mm^2$ which closely approximates the area of 7,680 $mm^2$ for two antennas which generates an omnidirectional radiation pattern.

Directional antennas have larger areas than omnidirectional antennas operating at the same frequency range. In general, directional antennas have lengths and widths which are double those of an omnidirectional antenna. Although not shown, it shall be appreciated that directional antennas have an area which is substantially greater than 0.6 tines the square of the wavelength of the center frequency of the transmitting or receiving frequency of each antenna. Additionally, directional antennas may have an additional backplate or a thick strip of metal on the back edge.

The bandwidth of the antenna 20 is determined by the shape of the tapered notch regions 26 and 28. By way of example and not of limitation, if the shape of the taper is exponential or the radius of curvature is a quadrant of a circle, then at least an octave bandwidth range may be achieved.

Impedance matching is accomplished by placing each conductive transmission line 34 and 36 in appropriate locations with respect to the tapered transmit notch radiator 26 and tapered receive notch radiator 28, thereby affecting the capacitance of the electrical coupling between the transmission line and the radiators. Impedance matching may be accomplished over a wide range of frequencies and the ASIC 38 can be matched directly with the antenna receive or transmit functions. Alternatively, the conducting line may be a coaxial cable. In summary, the dimensions and geometric configuration of each feed line affects the impedance matching requirements for the transmitting and receiving antenna.

FIGS. 3*a* and FIG. 3*b* illustrate the top and bottom views, respectively, of an alternative embodiment of the antenna of the present invention. The alternative embodiment is also an omnidirectional antenna. In FIG. 3*a*, the top view of a broadband antenna 41 has a conductive layer 42 deposited or etched on a substrate (not shown). Conductive layer 42 encompasses two tapered notches 44 and 46, each having a broad end 48 and 50 tapering down to slotines 52 and 54. The broad ends 48 and 50 are disposed on opposing edges of the substrate. The general configuration of the tapered notch regions 44 and 46 is a back-to-back, parallel arrangement where the broad ends 48 and 50 are disposed on opposing edges of the substrate. As previously described, the conductive lines 56 and 58 are positioned orthogonally to each of the notches 44 and 46 at the respective feed points.

Referring to FIG. 3*b*, there is shown the bottom view of antenna 41. A pair of conductive lines 56 and 58 are positioned orthogonally to each of the tapered notches 44 and 46. The conductive lines 56 and 58 have associated radial stubs 60 and 62, respectively, which are capacitively coupled to the tapered notch radiators 44 and 46, respectively. An integrated circuit such as ASIC 64 is electrically coupled to each of the conductive lines 56 and 58. ASIC 64 transmits and receives pulsed signals.

The geometric parameters defining antenna 41 as depicted in FIGS. 3*a* and 3*b* are for a squarely shaped antenna which has a length and width of 80 mm. The total area for this antenna is 6,400 $mm^2$, which less than the 7,680 $mm^2$ area which is the approximate antenna area needed to generate an omnidirectional radiation pattern. The tapered notches 44 and 46 fan out as an exponential notch or as the quadrant of a circle. The tapered notches 48 and 50 are geometrically configured so that each of the slotlines 52 and 54 are adjacent one another. The edge of slotline 52 is approximately 20.67 mm from the edge of slotline 54. Tapered notches 44 and 46 are positioned in the center of the conductive layer 42.

Impedance matching for omnidirectional antenna 41 is accomplished in the same manner as described for antenna 20. Additionally, it shall be appreciated that the omnidirectional antenna can take on a variety of geometric shapes such as round, oval and polygonal, etc. and that the embodiments for antenna 41 should not be construed as limiting.

Both the omnidirectional antenna 20 and omnidirectional antenna 41 transmit and receive a wideband of high frequency signals which include but are not limited to pulsed signals. Additionally, it shall be appreciated that the antennas 20 and 41 can be used in an antenna array applying methods well known in art of antenna design.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A broadband transmit/receive antenna, comprising:

a substrate having a first face and a second face;

a conductive layer disposed on said first face forming a transmitting radiator portion including a first tapered notch and a receiving portion including a second tapered notch; and first and second conductive lines formed on said second face forming first and second transmission lines, said first transmission line electrically coupled to said transmitting radiator portion at a first feed point and said second transmission line electrically coupled to said receiving portion at a second feed point.

2. The broadband antenna of claim 1 where each of said tapered notches comprise a size and a shape which determines an operating frequency range.

3. The broadband antenna of claim 2 where said notch shape comprises a quadrant of a circle.

4. The broadband antenna of claim 2 where said notch shape comprises an exponential notch.

5. The broadband antenna of claim 2 further comprising a predominantly omnidirectional radiation pattern generated by said antenna having a surface area for said substrate which approximates or is less than 0.6 times the square of a center wavelength for said operating frequency range.

6. The broadband antenna of claim 5 having said omnidirectional radiation pattern comprising a frequency range of 2.5 GHz to 5.0 GHz and said substrate having a length of 80 mm and width of 80 mm.

7. The broadband antenna of claim 5 having said omnidirectional radiation pattern comprising a frequency range of 2.5 GHz to 5.0 GHz and said substrate having a length of 135 mm and width of 60 mm.

8. The broadband antenna of claim 2 further comprising a predominantly directional radiation pattern generated by said antenna having a surface area for said substrate which is substantially greater than 0.6 times the square of a center wavelength for said operating frequency range.

9. The broadband antenna of claim 2 further comprising an integrated circuit resident on said second face resistively coupled to said first and said second conductive lines.

10. The broadband antenna of claim 9 further comprises a plurality of pulsed signals being transmitted and received by said integrated circuit.

11. The broadband antenna of claim 10 where said pulsed signal comprising a plurality of spread spectrum signals which are transmitted or received by said antenna.

12. The broadband antenna of claim 2 where each of said conductive lines further comprises a capacitive coupling to each of said first and said second tapered notches.

13. The broadband antenna of claim 12 where each of said conductive lines further comprises a radial stub at the end of each of said conductive lines which is capacitively coupled to said first tapered notch and said second tapered notch.

14. The broadband antenna of claim 2 where said conductive layer further includes a stop notch disposed between said first tapered notch and said second tapered notch for separating said transmitting portion of the antenna from said receiving portion of the antenna.

15. The broadband antenna of claim 2 further comprising an impedance matching circuit generated by locating each conductive line at an appropriate location with respect to each of said tapered notches.

16. A method for transmitting and receiving pulsed signals from a single antenna, comprising:

providing a transmit/receive antenna having a substrate with a first face and second face on which a conductive layer disposed on said first face forming a transmitting radiator portion and a second receiving portion;

transmitting signals from said transmit portion;

receiving signals from said receiving portion; and defining an operating frequency range by manipulating the size and shape of said transmitting radiator portion and receiving portion in a tapered notch configuration.

17. The method for transmitting and receiving signals as recited in claim 16, further comprising communicating a predominantly omnidirectional radiation pattern by generating a surface area for said first face and said second face which approximates or is less than 0.6 times the square of a center wavelength for said operating frequency.

18. The method for transmitting and receiving signals as recited in claim 17, further comprising communicating a predominantly directional radiation pattern by generating a surface area for said first face and said second face which is substantially greater than 0.6 times the square of a center wavelength for said operating frequency.

* * * * *